US006260843B1

(12) United States Patent
Hoshimura et al.

(10) Patent No.: US 6,260,843 B1
(45) Date of Patent: Jul. 17, 2001

(54) SHEET-RECEIVING DEVICE HAVING SORTING FEATURE

(75) Inventors: Takafumi Hoshimura; Yuji Suzuki, both of Yokohama; Shigeru Horiguchi, Kawasaki, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/189,396

(22) Filed: Nov. 10, 1998

(30) Foreign Application Priority Data

Nov. 11, 1997 (JP) ..... 9-308312
Aug. 26, 1998 (JP) ..... 10-240507

(51) Int. Cl.[7] ..... B65H 31/04
(52) U.S. Cl. ..... 271/213; 271/214; 271/207; 271/162; 414/907
(58) Field of Search ..... 271/213, 214, 271/215, 217, 218, 216, 162, 207; 414/923, 907

(56) References Cited

U.S. PATENT DOCUMENTS

| | | | |
|---|---|---|---|
| 4,350,330 | 9/1982 | Brown | 271/12 |
| 4,565,360 | 1/1986 | Runzi | 271/4.04 |
| 4,933,725 | 6/1990 | Ito | 399/369 |
| 5,454,555 | 10/1995 | Kiyohara et al. | 271/9.01 |
| 5,613,672 | 3/1997 | Tanaka et al. | 271/162 |

FOREIGN PATENT DOCUMENTS 61-151635 * 7/1986 (JP) .

OTHER PUBLICATIONS

English Abstract of Japanese Patent No. 52–67340, Dated May 18, 1977, with Attached pp. 85 and 86.
English Abstract of Japanese Patent No. 54–5437, Dated Jan. 13, 1979, with Attached pp. 101 and 102.
English Abstract of Japanese Patent No. 54–21849, Dated Feb. 19, 1979, with Attached pp. 475–478.
English Abstract of Japanese Patent No. 55–147340, Dated Oct. 23, 1980, with Attached pp. 89 and 90.
English Abstract of Japanese Patent No. 57–37953, Dated Feb. 27, 1982, with Attached pp. 133 and 134.
English Abstract of Japanese Patent No. 01–106473, Dated Jul. 18, 1989, with Attached p. 177.
English Abstract of Japanese Patent No. 03–51752, Dated May 20, 1991, with Attached pp. 1 and 2.
English Abstract of Japanese Patent No. 04–223965, Dated Aug. 13, 1992, with pp. 419–424.

* cited by examiner

*Primary Examiner*—Donald P. Walsh
*Assistant Examiner*—David A Jones
(74) *Attorney, Agent, or Firm*—Oblon, Spivak, McClelland, Maier & Neustadt, P.C.

(57) ABSTRACT

A sheet-receiving device has multiple sheet receiving faces on which to receive different print jobs. The print faces are positioned in tandem with respect to each other. Sheets ejected from an apparatus are ejected onto a first of the multiple faces and remain their until moved. If another print job is to be printed, the operator may move the first print job from the first sheet receiving face to the second sheet receiving face simply by sliding the first print job to the second sheet receiving face. The first print job snaps into place, and curled edges of upper sheets in the first print job are blocked by a barrier between the first and second sheet receiving face so that sheets in the first print job do not interfere with the reception of sheets in the second print job.

7 Claims, 8 Drawing Sheets

SHEET-RECEIVING DEVICE HAVING SORTING FEATURE

BACKGROUND OF THE INVENTION

1. Field of the Invention

The present invention relates to imaging devices and paper handling devices having a receiving device for receiving discharged papers from an outlet. More particularly, the present invention may be used with an image forming apparatus such as a digital copier or a facsimile.

2. Discussion of the Background

Recently in modern office environments, an image forming apparatus, such as a printer, is commonly connected to one or more host machines, such as personal computers. Computer users can perform a printing operation at the printer from any of the personal computers. The printer responds by printing a sheet and then discharging the printed sheet to a sheet receiving device.

In above mentioned printer system, there may be a situation in which printed and discharged sheets are left in a receiving tray, for example if the user leaves the printer to pick up a telephone call. In this situation, when another user uses the same printer, the newly printed sheets (i.e., the second print job) are discharged directly on top of the first print job. Stacking the two print jobs in this way gives rise to the possibility that either the first user or the second user will inadvertently take both print jobs when retrieving their print job from the printer. Once the mistake is discovered, the user must sort-out the different print jobs, identify the print job that is not theirs, and insert the other user's print job back in the printer receiving tray.

A conventional sheet-receiving device described in Laid-Open Japanese Utility Model document 57-135541 attempts to address the issue of separating print jobs. As shown in FIG. 16, a printer 90 has a tray 92 for receiving printed sheets from an outlet 91 and a sorting tray 93 that is rotatably mounted by pins 94 at a side of the tray 92 for holding printed sheets from another user's print job at a location adjacent to the tray 92. In this case, the user rotates the sorting tray 93 to a horizontal position, as shown by the dotted line, and moves the printed sheets in preparation for the next sheets to discharge.

Another conventional sheet-receiving device is described in Japanese Utility Model document 0351752. As shown in FIG. 17, this device includes a receiving tray 82 having a beveled faces 82*a*, 82*b*, 82*c* and 82*d* for pushing printed sheets discharged by rollers 81, down for each fixed positions 83, which are located at lower positions of each of the beveled faces 82*a*, 82*b*, 82*c* and 82*d*. Overhangs 84 are located at upper positions of the beveled faces 82*a*, 82*b*, 82*c* and 82*d*. When sorting printed sheets, the user moves printed sheets that have already printed on the beveled face 82*a* to the next beveled face 82*b*. When two print jobs are held on the beveled faces 82*a* and 82*b*, the user moves the print jobs to other beveled face 82*c* or 82*d*.

However, as presently recognized, a problem with the formerly described conventional approach is that the printer has to be positioned in an area that is sufficient far way from a wall or other obstruction that allows the sorting tray 93 to be lowered. The latter approach has a different problem as discussed below. Because of the overhang 84, as shown in FIG. 18, located at an upper portion of the fixed portion 83, the user, when sorting, has to slide a bundle of sheets "S" up to the beveled face 82*b*. Moreover, the user has to move a rear edge Sb of the sheets S over the overhang 84*a*. If a length "L" of the beveled face 82*b* is comparatively shorter against the sheets S, a front edge of the sheets S is suspended and upper sheets of the bundle of papers become warped. Therefore, the sheets S do not easily move down into the pocket of the fixed position 83 easily and requires the user to move the bundle of papers up to the next beveled face before sliding the paper bundle into the fixed position 83. This situation causes sheets to collide between the moved sheets and the next discharged sheets. Furthermore, when left in the warped position, the sheets take on a habitual curling tendency.

On the other hand, if a length L' of the beveled face 82*b* is comparatively longer than the sheets S, as shown in FIG. 19, the size of the receiving tray 82 increases.

SUMMARY OF THE INVENTION

The present invention has been made in view of the above-identified problems, and accordingly, an object of the present invention is to provide a sheet receiving device that overcomes the above-identified problems, as well as other problems. To this end, a feature of the novel sheet-receiving device is to provide a configuration that outputs and sorts sheets easily and precisely.

Another object of this invention is to provide a novel sheet-receiving device that has a capacity that can change as required.

Still another object of this invention is to provide a compact-sized sheet receiving device.

These and other objects are achieved with a sheet-receiving device having multiple sheet receiving faces on which to receive different print jobs. The print faces are positioned in tandem with respect to each other. Sheets ejected from an apparatus are ejected onto a first of the multiple faces and remain their until moved. If another print job is to be printed, the operator may move the first print job from the first sheet receiving face to the second sheet receiving face simply by sliding the first print job to the second sheet receiving face. The first print job snaps into place, and curled edges of upper sheets in the first print job are blocked by a barrier between the first and second sheet receiving face so that sheets in the first print job do not interfere with the reception of sheets in the second print job.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
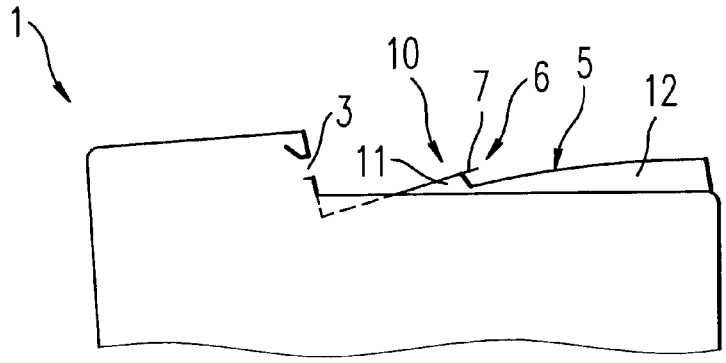
FIG. 1 is a side view of a printer of first embodiment having sheet-receiving device of this invention.
Figure 2:
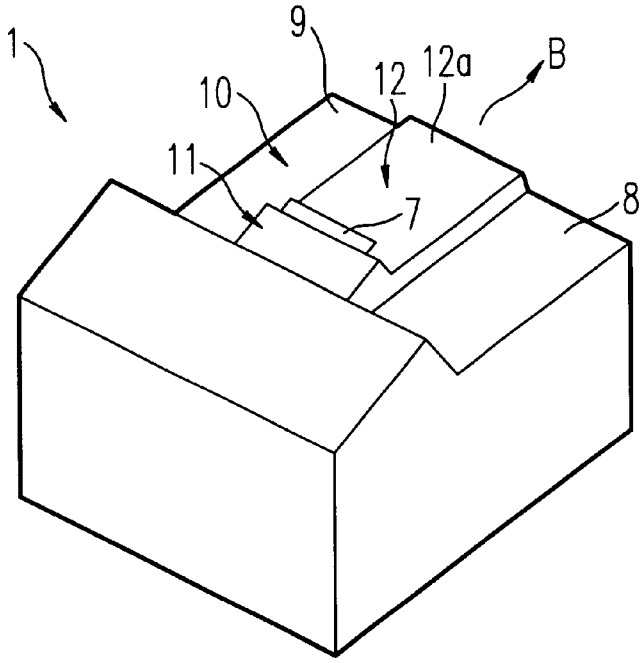
FIG. 2 is a perspective view of the first embodiment.

Referring now to the drawings, wherein like reference numerals designate identical or corresponding parts throughout the several views, FIG. 1 is a side view of a printer having a sheet-receiving device according to a first embodiment of the present invention. FIG. 2 is a perspective view of this embodiment.

Figure 3:
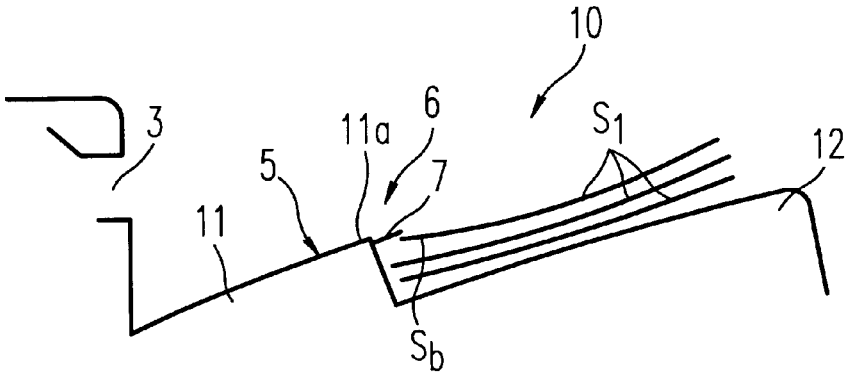
FIG. 3 is a side view of a sheet receiving mechanism of the first embodiment, where sheets are arranged in a first state.
Figure 4:
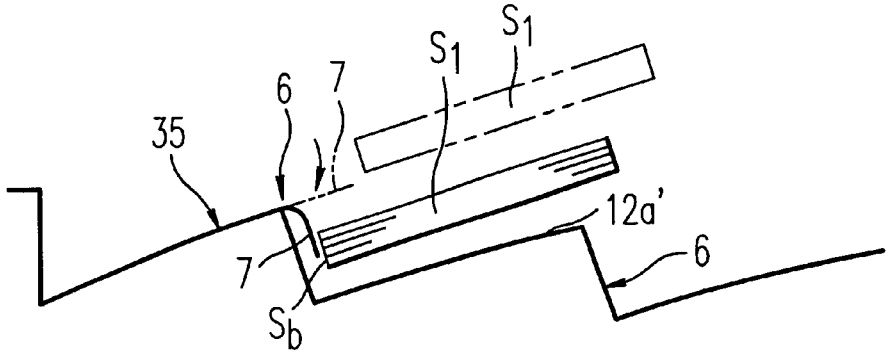
FIG. 4 is the same side view as FIG. 3, but sheets are arranged in another state.

The printer 1 has a sheet-receiving device 10 on to which ejected sheets from an image forming device, or other device, are discharged. The printed sheets are discharged from an outlet 3 and stacked on a receiving tray 5, which has a first tray 11 and a second tray 12. The first tray 11 is located upstream of the second tray 12 in a sheet feeding direction, and a step 6 is placed between the two trays. The step 6 has, as shown in FIG. 3, a thin board 7 (or projection formed) as a warp-inhibiting mechanism for regulating the rear edge of a bundle of printed sheets S1 so as avoid warped sheets in the stack from extending higher than a top 11*a* of the first tray 11, because the thin board 7 itself is located at upper portion of the step 6. Furthermore, the thin board 7 is parallel with a surface of the first tray 11 in normal condition. However, the thin board 7 is made of an elastic material, such as a resin film, so that, as shown in FIG. 4, when an operator slides the sheets S1 along the first tray 11 and the rear edge Sb of the sheets S1 is pulled-out from the first tray 11, the weight of the sheets S1 is over the thin board 7 so the thin board is folded (i.e., bent or moved down) and the sheets S1 fit in the second tray 12 in a snapping action.

This sheet-receiving device 10 has, as shown in FIG. 2, lower parts 8, 9 which are located lower than the receiving tray, so that the operator can easily grasp and remove the printed sheets from the receiving tray 5. One or more lower parts may be placed on either side of the trays 11, 12.

This sheet-receiving device 10 is especially well suited for printers that support connections to several computers by way of a network, for example. That is because when a user operates the computer or word processor to print out from the printer 1 under conditions of which the printer has discharged sheets on the receiving device 10 by other users and goes to the printer to take out his printed sheets, he can pull out the others and put them on the second tray 12 as shown in FIG. 3. Often there is sufficient time for the user to arrive at the printer before the user's print job has started. Accordingly, when the user takes out his printed sheets after all of his sheets were discharged, the user can easily distinguish between a bundle of his sheets, e.g. sheets S2, and the other bundle of sheets S1 as both sets of sheets only partially overlap, as shown in FIG. 5.

As mentioned above, as both trays 11, 12 are placed on the top of the printer 1, a layout of the receiving tray 12 looks simple and small in comparison with a printer equipped with a side mounted sorting tray. Furthermore, the existence of sheets on the tray 12 makes the user conveniently aware that the sheets are available for pick-up.

Figure 5:
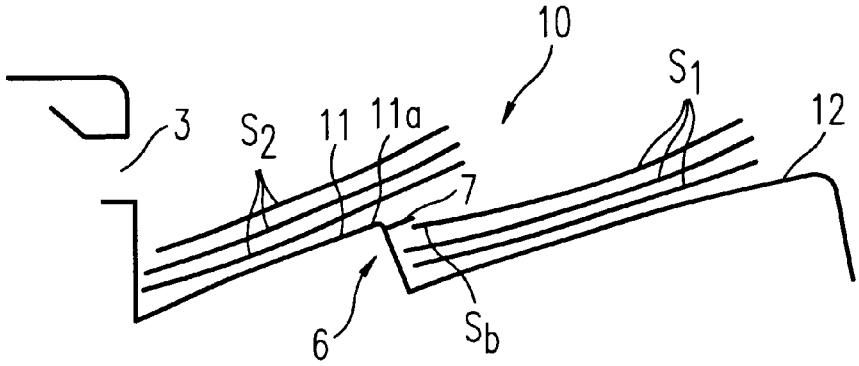
FIG. 5 is the same side view as FIGS. 3 and 4, where relative positions of two sets of sheets are shown.
Figure 6:
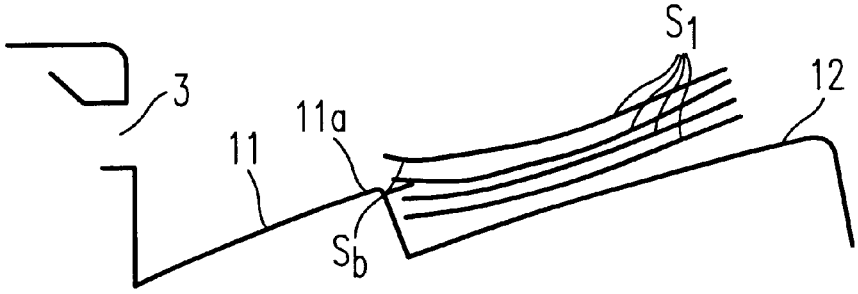
FIG. 6 is the same side view as FIGS. 3–5, where one of the two sets of sheets is removed from a first tray.

Still further, even if the top sheets of the sheets S1 are warped, as the thin board 7 pushes the back edge Sb of the sheets S1, as shown in FIG. 5, a sheet collision between the sheets S1 and the sheets S2 does not occur. However, if the thin board 7 is absent or removed, the back edge Sb, if warped, may extend over the top of the first tray 11*a*, as shown in FIG. 6.

Figure 17:
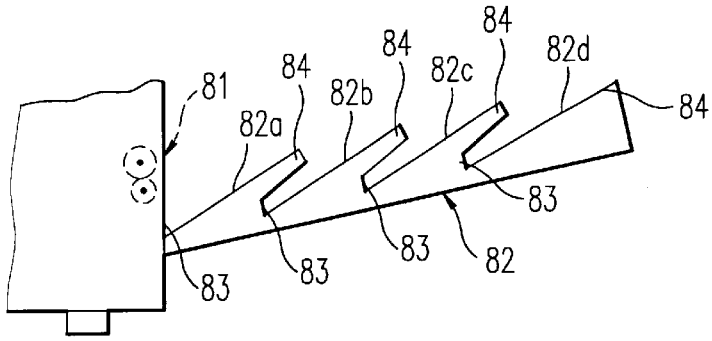
FIG. 17 (PRIOR ART)
FIG. 17 is a side view of another conventional sheet receiving mechanism.
Figure 18:
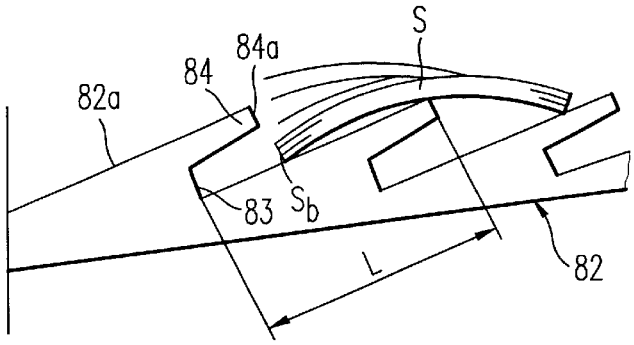
FIG. 18 (PRIOR ART)
FIG. 18 is a side view of the sheet receiving mechanism of FIG. 17, where a set of sheets is positioned on the sheet feeding mechanism.
Figure 19:
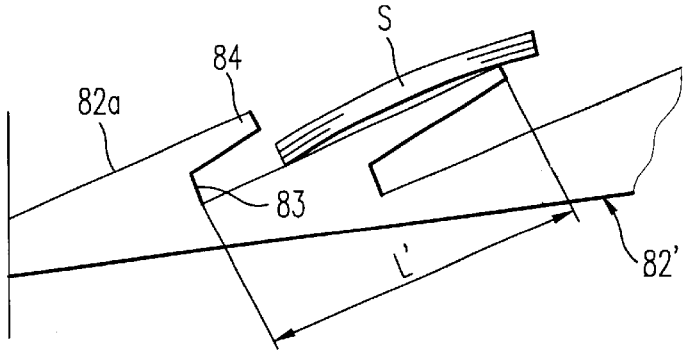
FIG. 19 (PRIOR ART)
FIG. 19 is another side view of the conventional sheet feeding mechanism of FIG. 17, where a length between sheet holding trays is longer than that shown in FIG. 18.

In this embodiment, a user can conveniently maintain the separation between discrete print jobs by moving a previously printed print job to the next tray simply by sliding the sheets backward and dropping the sheets in the next tray. Moreover, the user need not push the sheets down in the next tray and does not have to move the sheets over the overhang like the sheet-receiving device shown in FIG. 17. Furthermore, this sheet receiving device is compact in structure as compared to the sheet receiving device having unnecessary length L' of tray surface shown in FIG. 19. Adopting this receiving device, the printer, even a small sized printer having a little space in a discharging direction, can mount this sheet receiving device on the top thereof without protrusion of the front-end of the second tray.

Figure 7:
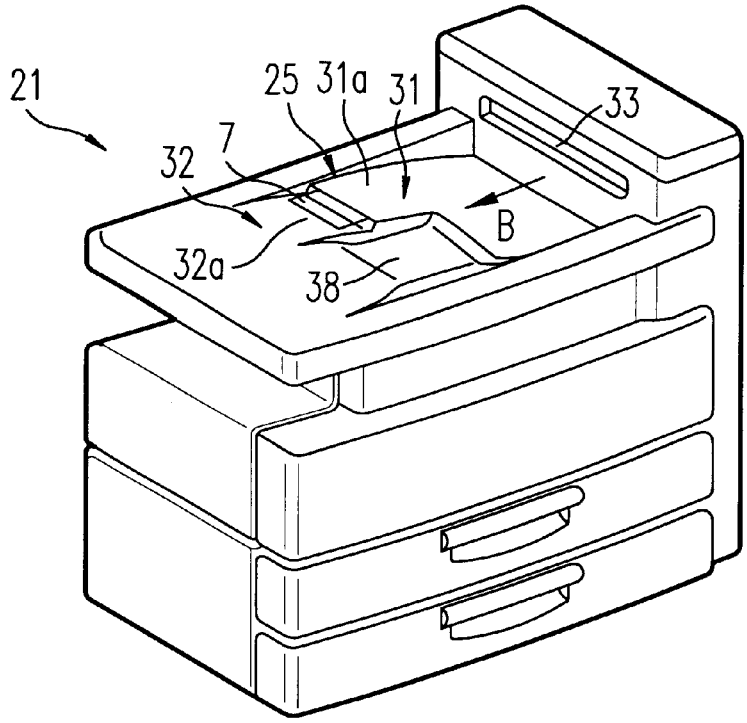
FIG. 7 shows a portrait view of a printer according to a second embodiment of this invention.
Figure 8:
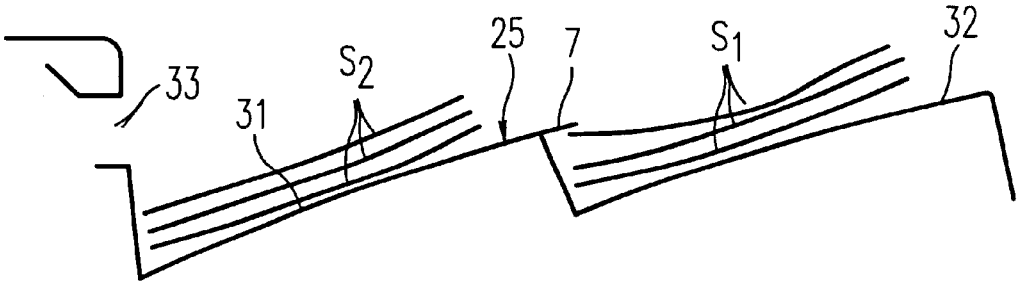
FIG. 8 is a side view of the sheet receiving mechanism of the second embodiment, where relative positions of two sets of sheets are shown.

FIG. 7 shows a perspective view of a medium sized printer according to the second embodiment of this invention. As this printer is larger in comparison with the printer of the first embodiment, a receiving device is larger. Accordingly, the first tray 31 can receive normally sized printed sheets discharged from an outlet 33 without overlap between sheets S2 in the first tray 31 and sheets S1 in a second tray 32, as shown in FIG. 8.

This printer 21 has a lower part 38, which is lower than a surface 31*a* of the first tray 31 and a surface 32*a* of the second tray 32, and which is provided on one side of the first tray 31 in a discharging direction shown as an arrow B in FIG. 7. A user, therefore, can grasp and take off the sheets from the first tray 31 or the second tray 32 easily by putting his hand into the lower part 38.

Figure 9:
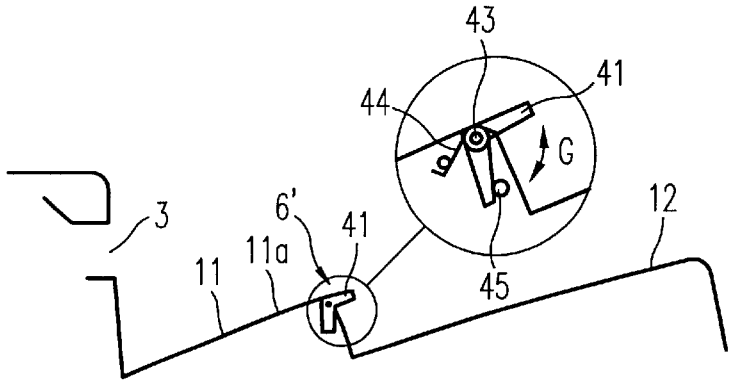
FIG. 9 is a side view of a third embodiment of a sheet receiving mechanism according to the present invention and includes a warp-inhibiting mechanism.

FIG. 9 illustrates a third embodiment of the present invention and includes another type of warp-inhibiting mechanism. This warp-inhibiting mechanism has a protrusion 41 at the top of a step 6. The protrusion 41 sticks out over the second tray 12 in sheet feeding direction. This protrusion 41 can rotate about a shaft 43 in directions indicated by the arrow G and that is biased in counterclockwise direction by a spring 44. In normal condition, the protrusion 44 is regulated in degree of turn by a pin 45. When adding a weight of sheets on the protrusion 44, the protrusion is turned in a clockwise direction opposing an elasticity of the spring 44. Consequently, the sheets are moved and fit in the second tray 12 in a snap action.

Figure 10:
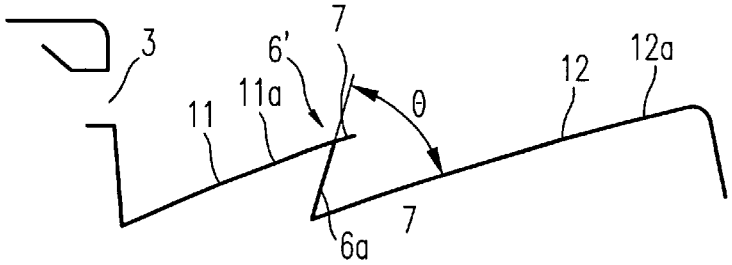
FIG. 10 is a side view of a fourth embodiment of a sheet receiving mechanism according to the present invention.

FIG. 10 illustrates a fourth embodiment of this invention and includes a step 6' that has a shape that is different from that of above-mentioned sheet receiving devices. The step 6' has a longitudinal wall 6*a*, and that wall 6*a* and a tray surface 12*a* of the second tray 12 form a corner with an acute angle θ (θ<90 degree). As the corner is acute, the wall 6*a* helps the thin board 7 to hold down curled edges of sheets in the second tray 12.

Figure 11:
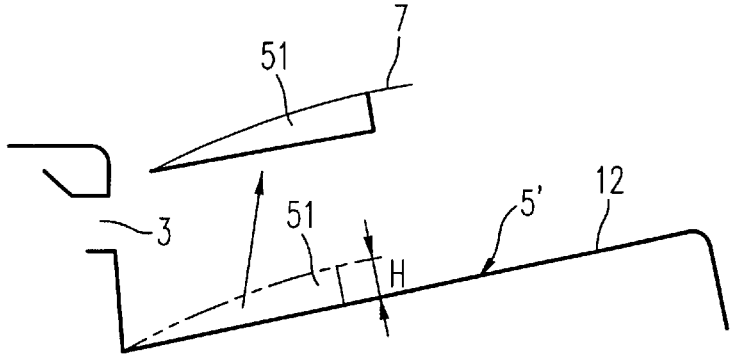
FIG. 11 is a side view of a fifth embodiment of a sheet receiving mechanism according to the present invention.

FIG. 11 illustrates a fifth embodiment of this invention, a feature of which is providing a removable tray as a first tray 51 from a receiving tray 5'. In this embodiment, when the first tray 51 is pulled from the receiving tray 5', a carrying capacity of the receiving tray 5' increases by an amount of a height H, without an occurrence of sheet deviating or warping.

Figure 12:
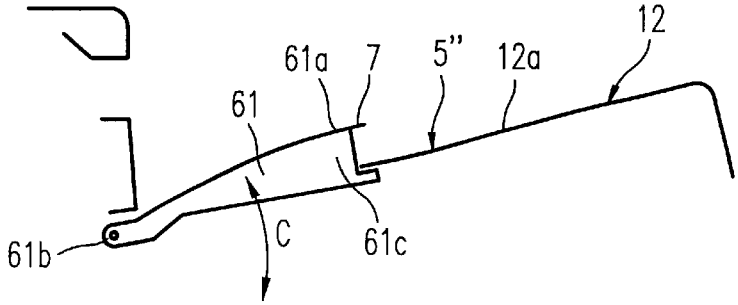
FIG. 12 is a side view of a sixth embodiment of a sheet receiving mechanism according to the present invention.
Figure 13:
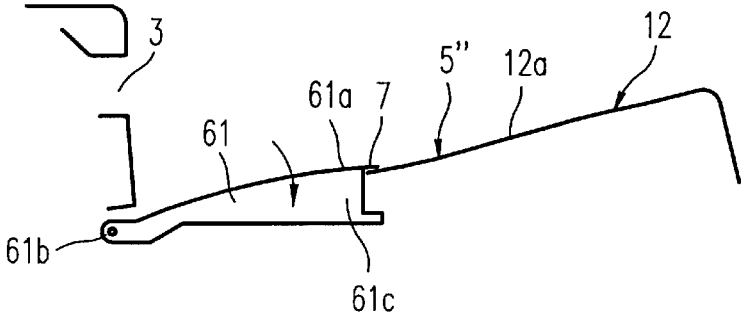
FIG. 13 shows a retractable tray feature of the sixth embodiment of the present invention.

FIG. 12 shows a sixth embodiment of this invention. This receiving device includes a first tray 61 that can rotate about a shaft 61*b* in directions indicated by an arrow C. When the first tray 61 is retracted, for example by the action of a lever (not shown), a surface 61*a* of the first tray 61 becomes nearly equal to a surface 12*a* of the second tray 12 in height, as shown in FIG. 13, and a carrying capacity of the receiving tray 5" increases, as a result.

Figure 14:
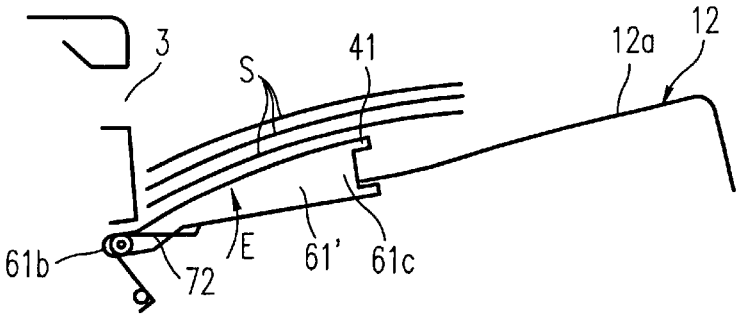
FIG. 14 is a side view of a seventh embodiment of a sheet receiving mechanism according to the present invention.
Figure 15:
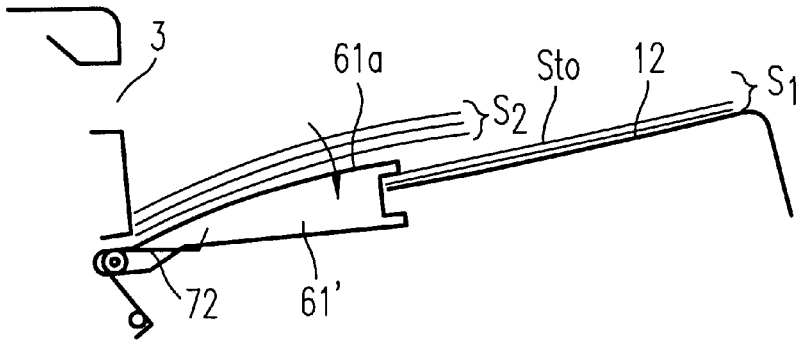
FIG. 15 is a side view of the seventh embodiment of the sheet receiving mechanism according to the present invention where two sets of sheets are accommodated.
Figure 16:
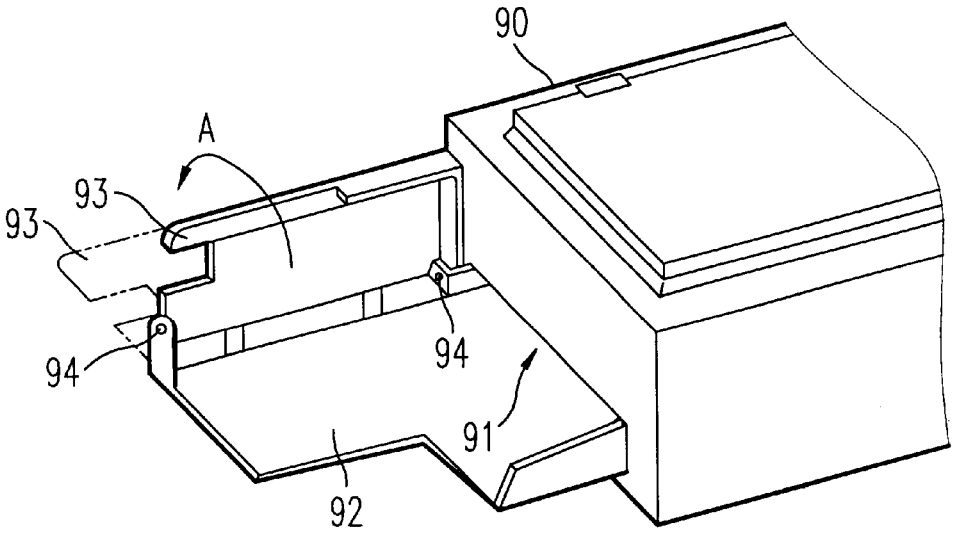
FIG. 16 (PRIOR ART)
FIG. 16 is a perspective view of a conventional printer and sheet receiving mechanism.

FIG. 14 shows a seventh embodiment of this invention. This receiving device has a first tray 61', which can rotate about a shaft 61*b* and which is lifted up by a spring 72. When sheets S are gradually stacked on the first tray 61', the first tray 61' is urged down by the weight of the sheets S and a carrying capacity of the first tray 6' increases in response to the amount of the sheets S. Furthermore, even if a user has sorted and put prior sheets on a second tray 12 before this receiving, a protrusion 41 makes a distinction between the sheets S2 and the sheets S1 with reliability, as shown in the circled region in FIG. 15. As a consequence, the protrusion delineates the two sets of sheets.

The above mentioned embodiments are explained in detail for the case of a printer. However, this invention can be applied to other image forming apparatuses, and other devices that involve processing sheets of paper or the like.

The present document is based on Japanese Patent Application Nos. 09-308312, filed in Japan on Nov. 11, 1997, and 10-240507, filed in Japan on Aug. 26, 1998, the entire contents of both of which being incorporated herein by reference.

Obviously, numerous modifications and variations of the present invention are possible in light of the above teachings. It is therefore to be understood that within the scope of the appended claims, the invention may be practiced otherwise than as specifically described herein.

What is claimed is:

1. An apparatus having a sheet-receiving device for receiving sheets discharged from an outlet, said sheet-receiving device comprising:

a first tray positioned adjacent to said outlet and having a surface configured to hold said sheets thereon when the sheets are discharged from said outlet, said first tray having a near side and a far side, said near side being adjacent to said outlet and said far side being opposite to said near side and having a step portion;

a second tray connected to the far side of said first tray and being located lower than said surface of said first tray and farther from the outlet than the first tray in a sheet moving direction of said sheets; and a warp-inhibiting mechanism configured to hold down a rear edge of the sheets when the sheets are positioned on the second tray and configured to prevent a forward edge of the sheets from warping over the step portion of the first tray when the sheets are on the surface of the first tray, said warp-inhibiting mechanism being set on a top of the step portion and having an extension portion that extends out over the second tray in a direction substantially parallel with the surface of the first tray, wherein the extension portion being configured to move downward with respect to said substantially parallel direction when exposed to a predetermined external force.

2. The apparatus of claim 1, wherein:

said the warp-inhibiting mechanism being made of an elastic layer.

3. The apparatus of claim 1, further comprising:

a lower surface positioned at a common side of both the first tray and the second tray and being lower than the first tray and the second tray, with respect to said substantially parallel direction.

4. The apparatus of claim 1, wherein, the apparatus is an image forming apparatus and the sheet-receiving device is positioned at a top of the image forming apparatus.

5. An apparatus having a sheet-receiving device for receiving sheets discharged from an outlet, said sheet-receiving device comprising:

a first tray detachably attached adjacent to said outlet and having a surface configured to hold said sheets thereon when the sheets are discharged from said outlet, said first tray having a near side and a far side, said near side being adjacent to said outlet and said far side being opposite to said near side and having a step portion;

a second tray in contact with the far side of said first tray and being located lower than said surface of said first tray and farther from the outlet than the first tray in a sheet moving direction of said sheets; and a warp-inhibiting mechanism configured to hold down a rear edge of the sheets when the sheets are positioned on the second tray and configured to prevent a forward edge of the sheets from warping over the step portion of the first tray when the sheets are on the surface of the first tray, said warp-inhibiting mechanism being set on a top of the step portion and having an extension portion that extends out over the second tray in a direction substantially parallel with the surface of the first tray.

6. The apparatus of claim 5, wherein, the apparatus is an image forming apparatus and the sheet-receiving device is positioned at a top of the image forming apparatus.

7. An apparatus having a sheet-receiving device for receiving sheets discharged from an outlet, said sheet-receiving device comprising:

a first tray positioned adjacent to said outlet and having a surface configured to hold said sheets thereon when the sheets are discharged from said outlet, said first tray having a near side and a far side, said near side being adjacent to said outlet and said far side being opposite to said near side and having a step portion;

a second tray opposing the far side of said first tray and being located lower than said surface of said first tray and farther from the outlet than the first tray in a sheet moving direction of said sheets; and means for inhibiting the sheets from being warped when held by said first tray and for preventing warped sheets in said second tray from interfering with a flight path of other sheets being discharged from said outlet, said means for inhibiting including, means for holding down a rear edge of the warped sheets when the sheets are positioned on the second tray, and means for preventing a forward edge of the sheets are held on the first tray from warping over the step portion of the first tray when the sheets are on the surface of the first tray.

* * * * *